US007267606B2

(12) United States Patent
Hsieh

(10) Patent No.: US 7,267,606 B2
(45) Date of Patent: Sep. 11, 2007

(54) ANGLE RETAINING ASSEMBLY OF A HAND TOOL

(76) Inventor: Chih-Ching Hsieh, 5F.-2, No. 181, Sec. 2, Mei Tsun Rd., South District, Taichung City (TW)

( * ) Notice: Subject to any disclaimer, the term of this patent is extended or adjusted under 35 U.S.C. 154(b) by 0 days.

(21) Appl. No.: 11/332,320

(22) Filed: Jan. 17, 2006

(65) Prior Publication Data

US 2007/0163401 A1 Jul. 19, 2007

(51) Int. Cl.
*B25B 23/16* (2006.01)
*B25B 7/00* (2006.01)

(52) U.S. Cl. ..... 451/177.7; 81/177.8; 81/415; 81/427.5

(58) Field of Classification Search ..... 81/177.7, 81/177.8, 427.5, 415, 177.9
See application file for complete search history.

(56) References Cited

U.S. PATENT DOCUMENTS

| | | | | |
|---|---|---|---|---|
| 1,155,937 | A * | 10/1915 | Lerfald | 81/165 |
| 6,370,992 | B1 * | 4/2002 | Shih-Kuei | 81/427.5 |
| 2004/0221695 | A1 * | 11/2004 | Hsien | 81/427.5 |
| 2006/0090613 | A1 * | 5/2006 | Hsieh | 81/177.8 |

* cited by examiner

*Primary Examiner*—Hadi Shakeri

(57) ABSTRACT

An angle retaining assembly of a hand tool comprises a handle; a head having at least one screw hole for receiving at least one resisting element; when the resisting element screws into the screw hole; a front end of the resisting element protrudes out to be in contact with the pivotal portion of the handle to have a resisting effect so as to fix the bending angle between the head and the handle. The at least one screw hole is formed at a lateral side or a front side of the connecting portion. Or the at least one screw hole is formed at a lower side of pivotal portion of the handle.

4 Claims, 7 Drawing Sheets

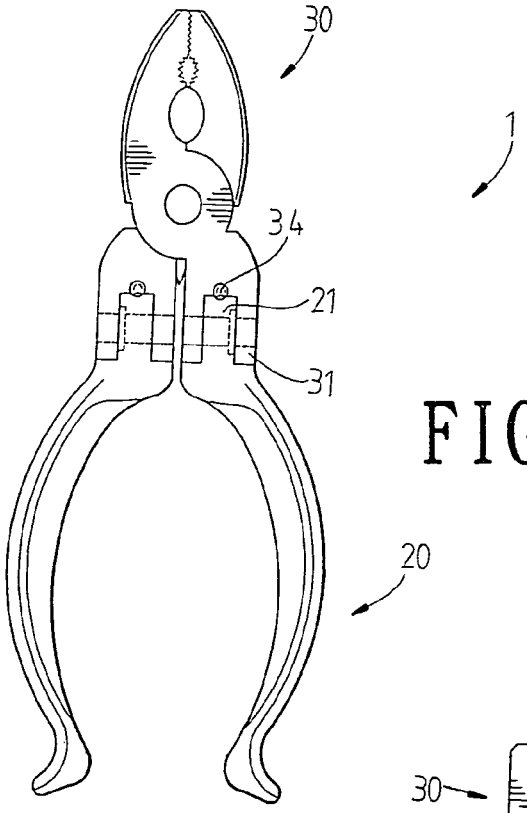
FIG. 6
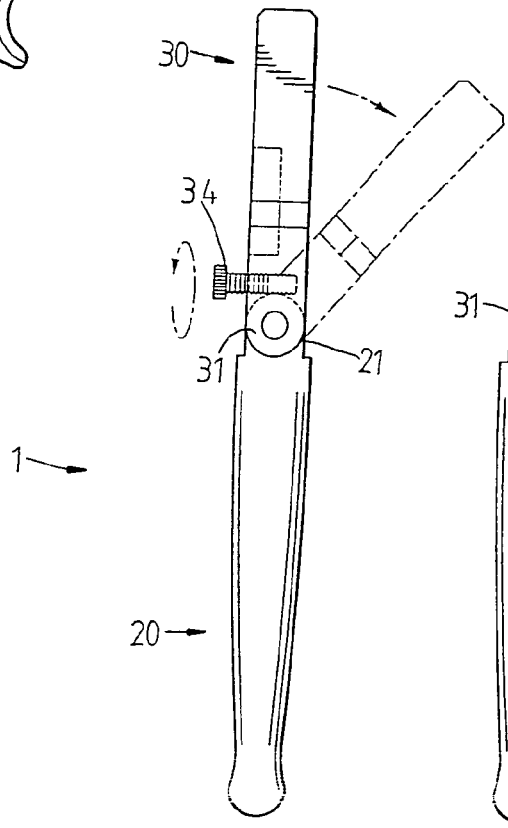
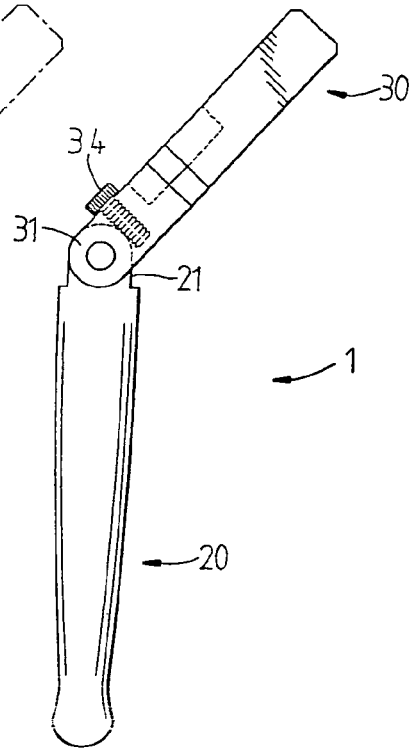
FIG. 7 FIG. 8

ANGLE RETAINING ASSEMBLY OF A HAND TOOL

FIELD OF THE INVENTION

The present invention relates to retaining assemblies, and in particular to an angle retaining assembly of a hand tool for retaining the angle a hand tool with two pivotal elements, such as pliers or scissors.

BACKGROUND OF THE INVENTION

For the clamping hand tool, it is important that the tool can be held comfortably. However another problem for the hand tool is that it is often that the hand tool must be used in various locations which cannot well locate the hand tool so that the user will feel uncomfortable.

In one prior art, Taiwan Patent No. 577375 disclosed a bendable adjusting structure is installed at a handle of a clamping tool. However no structure is designed to retain an angle in the tool after it is adjusted. Thereby the clamping end is possibly moved after adjustment. Thereby the user will feel uneasy in operation.

SUMMARY OF THE INVENTION

Accordingly, the primary object of the present invention is to provide an angle retaining assembly of a hand tool for retaining the angle a hand tool with two pivotal elements, such as pliers or scissors.

To achieve above objects, the present invention provides an angle retaining assembly of a hand tool which comprises a handle; a head having at least one screw hole for receiving at least one resisting element; when the resisting element screws into the screw hole; a front end of the resisting element protrudes out to be in contact with the pivotal portion of the handle to have a resisting effect so as to fix the bending angle between the head and the handle. The at least one screw hole is formed at lateral side or front side of the connecting portion. Or the at least one screw hole is formed at a lower side of pivotal portion of the handle.

The various objects and advantages of the present invention will be more readily understood from the following detailed description when read in conjunction with the appended drawing.

BRIEF DESCRIPTION OF THE DRAWINGS

FIG. 6 is a further perspective view of the second of the present invention.

FIGS. 7 and 8 are schematic views of the second embodiment of the present invention.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
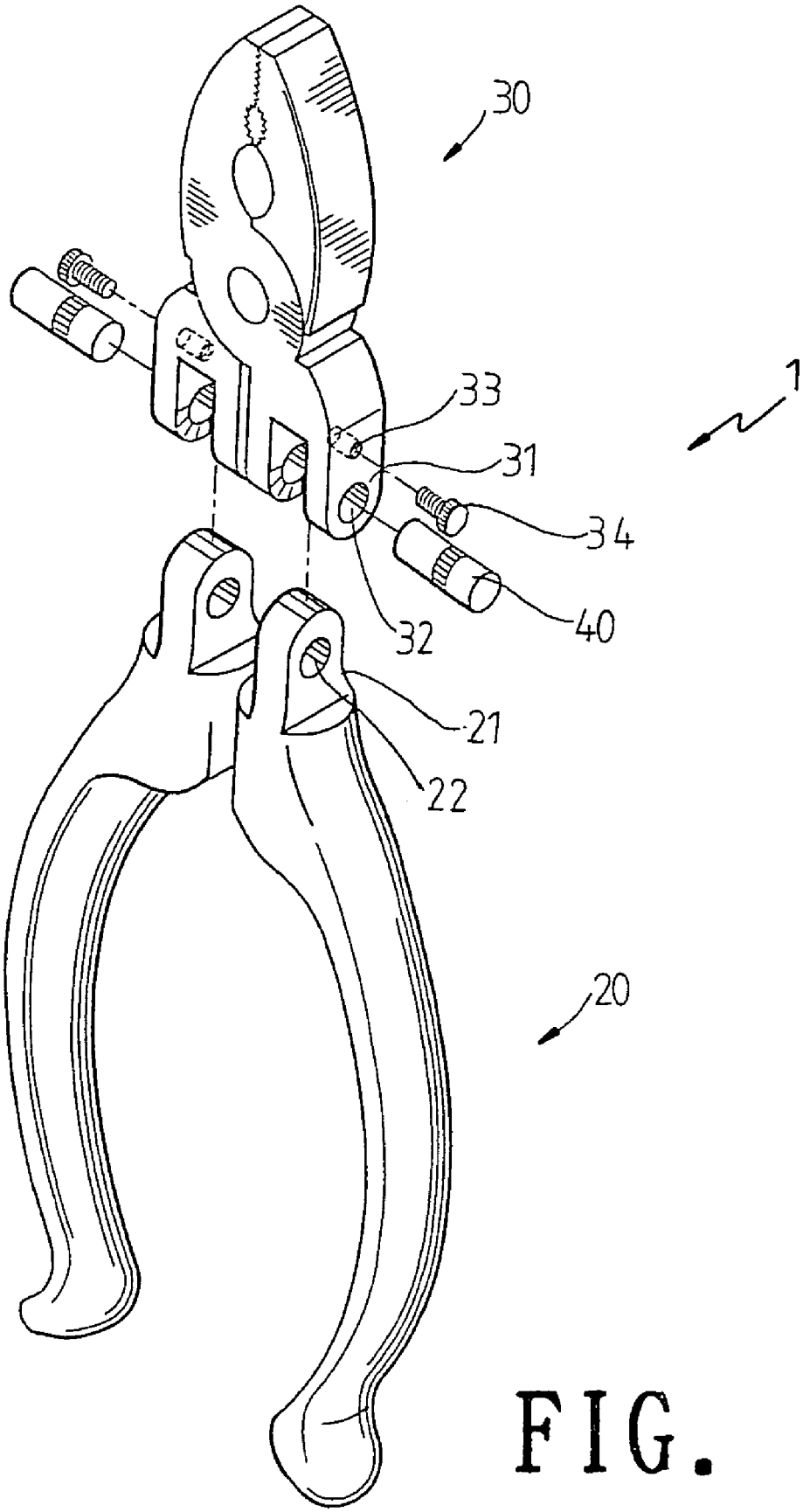
FIG. 1 is an exploded perspective view of the angle retaining assembly of a hand tool of the present invention.
Figure 2:
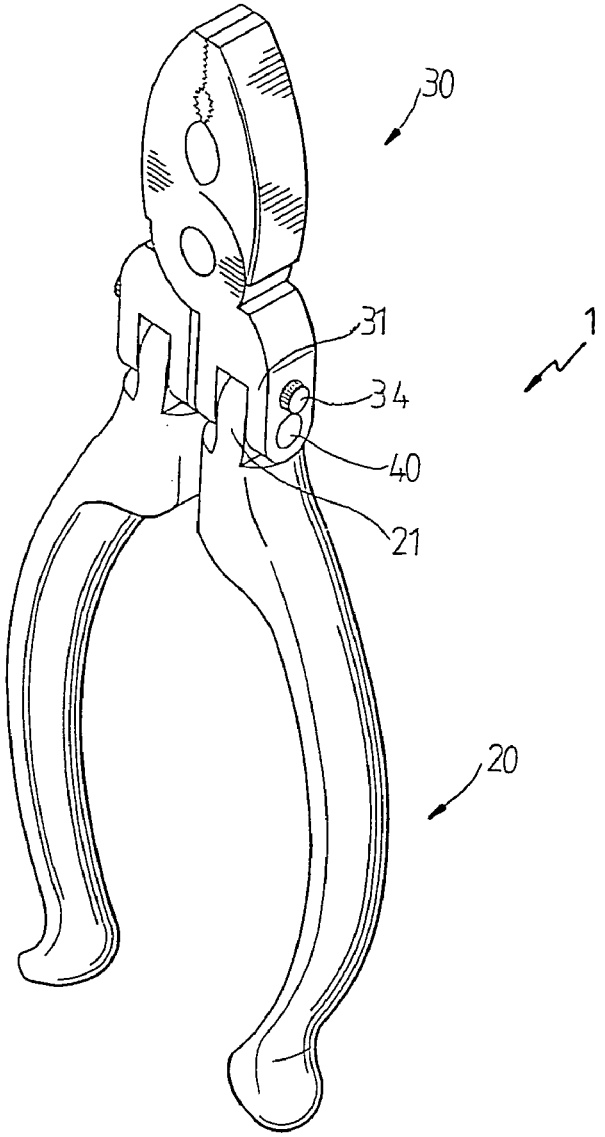
FIG. 2 is a perspective view of the angle retaining assembly of a hand tool of the present invention.
Figure 3:
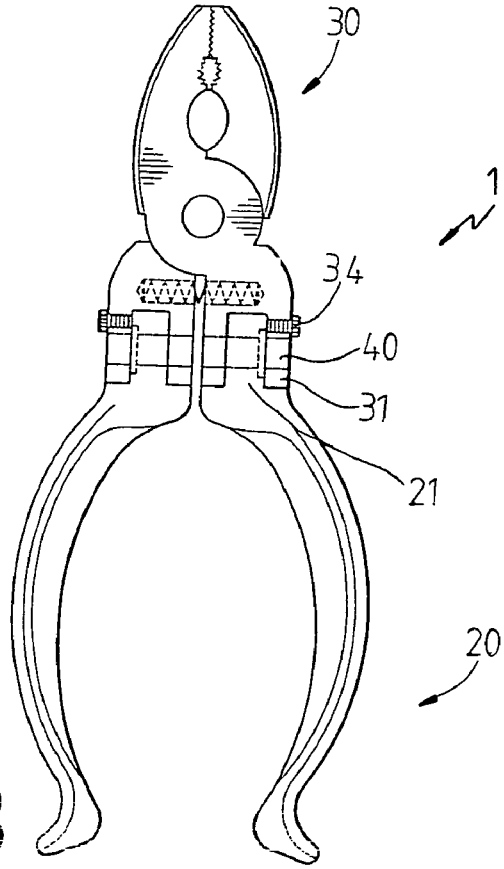
FIG. 3 is a cross sectional view about the angle retaining assembly of a hand tool of the present invention.

Referring to FIGS. 1 to 3, the structure of the present invention is illustrated. The present invention has the following elements.

A body 1 has the following elements.

A handle 20 has one end formed with a pivotal portion 21. Two side of the pivotal portion 21 are planes and have through holes 22. The handle 20 has two holding portions which are separated without any connection therebetween. Each holding portion has an upper end formed with a pivotal portion 21; each pivotal portion 21 having a through hole 22.

A head 30 is installed to the through holes 22 of the handle 20. One end of the head 30 is formed with a connecting portion 31 having a configuration corresponding to the shape of the pivotal portion 21. A lower side of the head 30 has two U shape recesses. The screw hole 32 is located aside a corresponding one of two the two recesses. Each of the two U shape recesses serves for receiving a corresponding one of the two pivotal portions 21. Two sides of each recess is formed with axial holes 32. In assembly a pivotal shaft 40 passes through the through hole 22 of a corresponding one of the two holding portions of the handle 20 and the axial holes of the head 30. Thereby the handle 20 is pivoted to the head 30. Above-mentioned is known in the prior art and thus the detail will not be further described herein.

Each of two lateral side of the connecting portion 31 has a respective screw hole 33 for receiving a resisting element 34. When the resisting element 34 screws into the screw hole 33. A front end of the resisting element 34 protrudes out to be in contact with the pivotal portion 21 of the handle 20 (referring to FIG. 3) to have a resisting effect so as to fix the bending angle between the head 30 and the handle 20.

Figure 4:
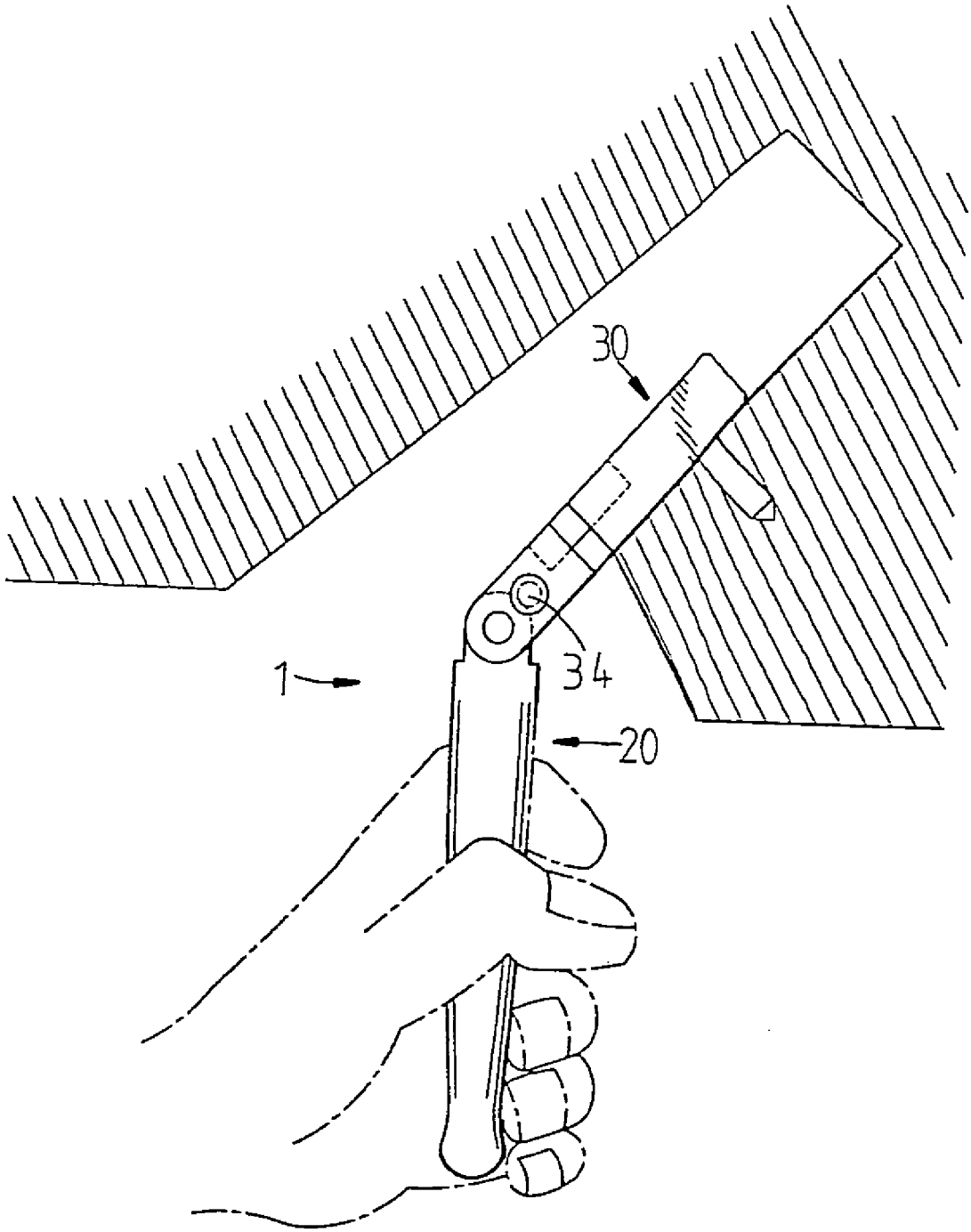
FIG. 4 is a schematic view of the angle retaining assembly of a hand tool of the present invention.
Figure 5:
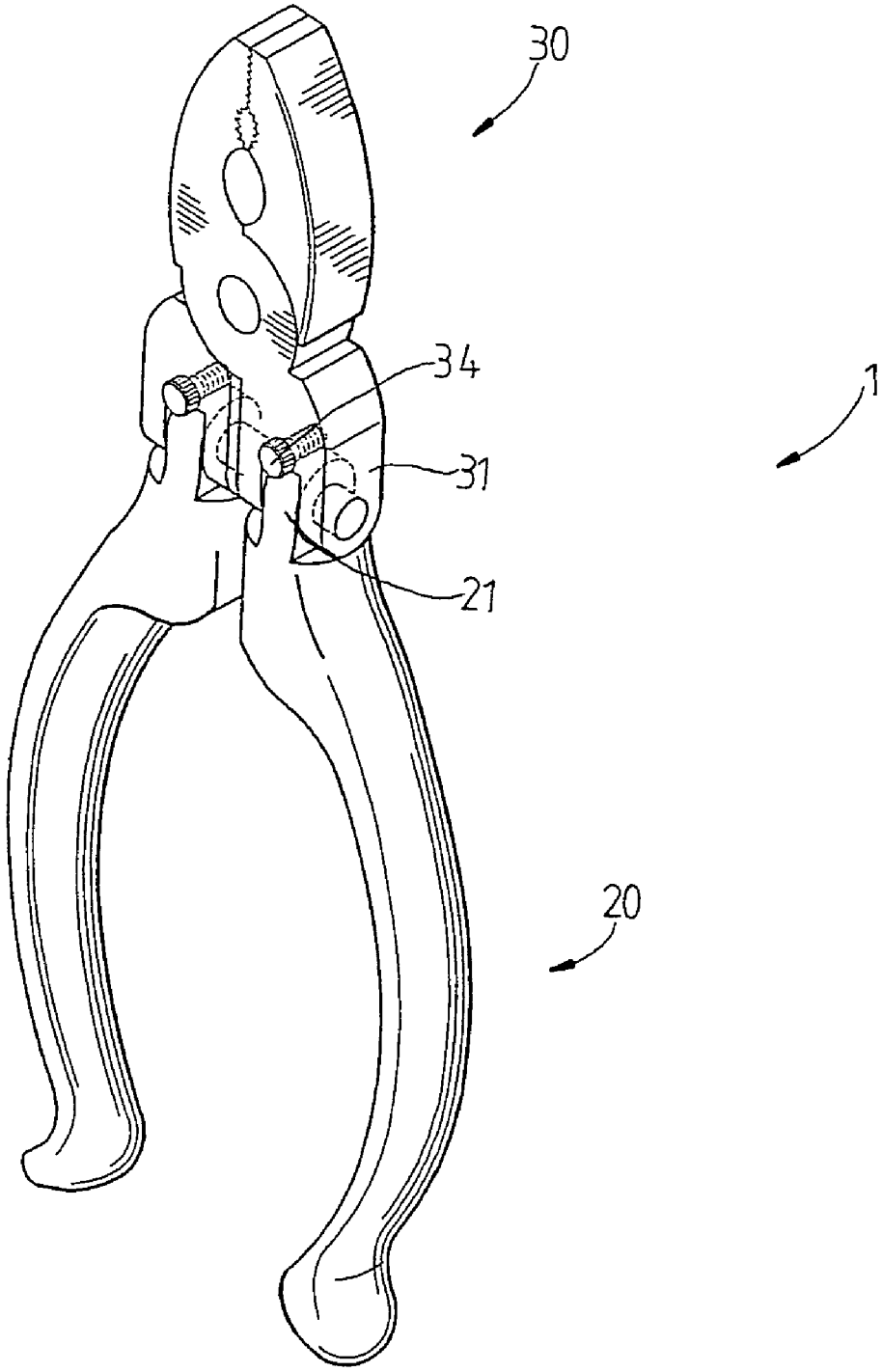
FIG. 5 is a perspective view of the second embodiment of the present invention.
Figure 9:
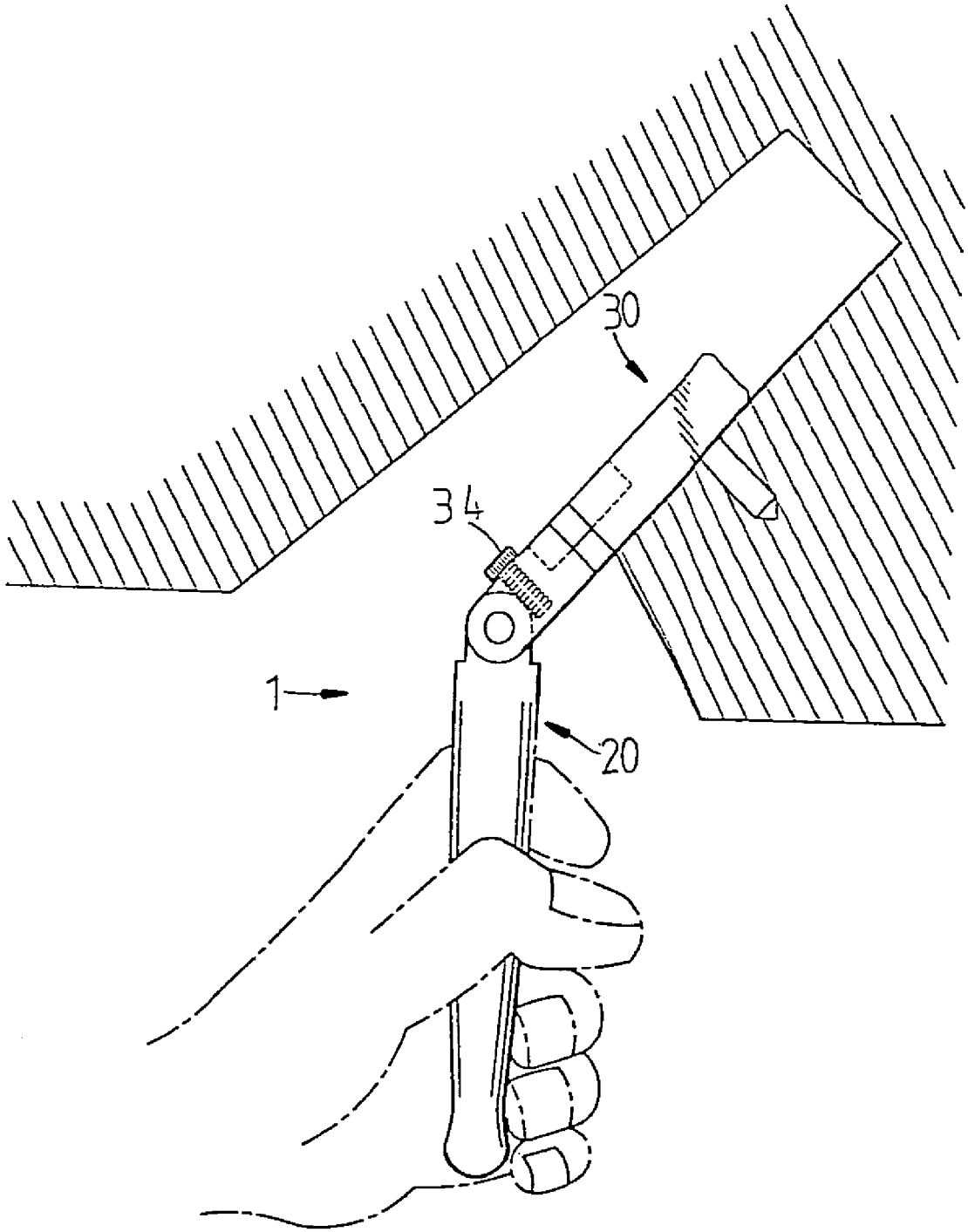
FIG. 9 shows the application of the second embodiment of the present invention.

Referring to FIG. 4, in use of the present invention, the angle between the head 30 and the handle 20 is adjustable so that the hand tool body 1 can be inserted into an operation environment. When the resisting element 34 is screwed to a tight position, the angle between the handle 20 and head 30 is retained to avoid swing of the two elements and the operation can be performed steadily.

Referring to FIGS. 5 to 9, the second embodiment of the present invention will be described herein. Those identical to the first embodiment will not be described herein. Only the difference therebetween are described. In the present invention, the screw holes 33 can be formed at the front surface of the head 30. When the resisting elements 34 screw into the screw holes 33, the resisting elements 34 resist against a top end of the handle 20 so as to fix the handle 20 to the head 30 by the friction force of the handle 20 and the head 30. Thereby they have the same effect as that in the first embodiment. In adjustment, as illustrated in FIGS. 7 and 8, when the angle between the handle 20 and the head 30, the resisting element 34 can be used to retain the angle so that the hand tool can be inserted to an operation place (referring to FIG. 9).

Figure 10:
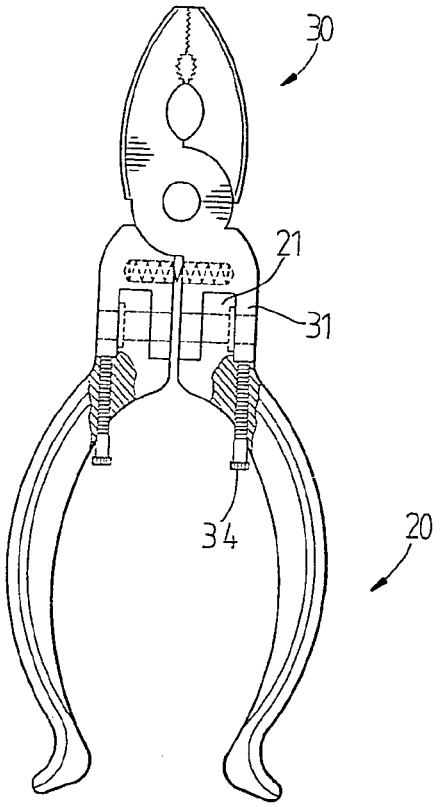
FIGS. 10 and 11 are partial schematic views about the third embodiment of the present invention.
Figure 11:
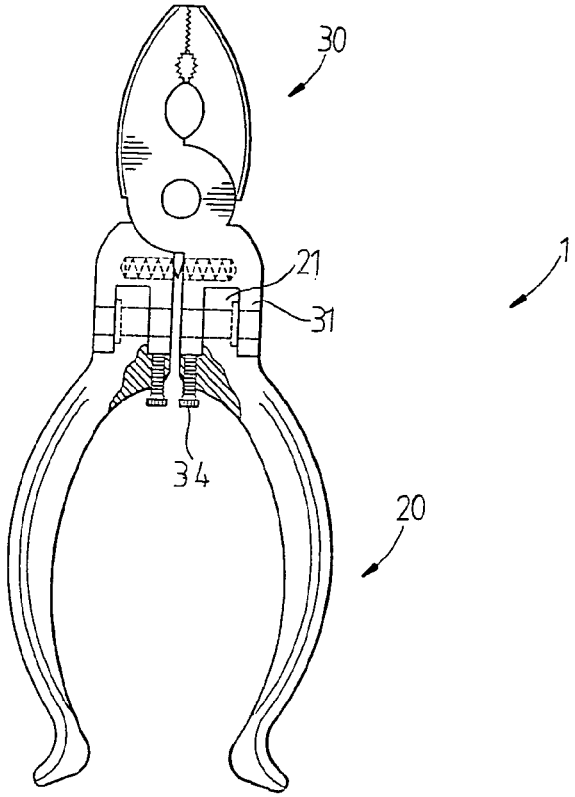

Referring to FIGS. 10 and 11, the third embodiment of the present invention is illustrated. Those identical to the first embodiment will not be described herein. Only the difference therebetween are described. In the present invention, the screw holes 33 can be installed at a lower side of the pivotal portion 21 of the handle 20. The resisting elements 34 can screw into the screw holes 33 to resist against the connecting portion. By the friction force between the resisting element 34 and the connecting portion, the angle between the head 30 and the handle 20 can be retained so as to have the effect as the first embodiment as shown in FIGS. 10 and 11.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An angle retaining assembly of a hand tool comprising:

a handle; the handle having two holding portions which are separated without any connection therebetween; each holding portion having an upper end formed with a pivotal portion; each pivotal portion having a through hole;

a head; one end of the head being formed with a connecting portion having a configuration corresponding to the shape of the pivotal portion; the head having two screw holes at two outer lateral sides thereof; each screw hole serving for receiving a corresponding resisting element; a lower side of the head having two U shape recesses; each screw hole being aside a corresponding one of the two recesses; each of the two U shape recesses serving for receiving a corresponding one of the two pivotal portions; two sides of each recess being formed with axial holes; a pivotal shaft passing through each of the through hole of a corresponding one of the two holding portions of the handle and the axial holes of the head;

wherein when the resisting element screws into the screw hole; a front end of the resisting element protrudes out to be in contact with the pivotal portion of the handle to have a resisting effect so as to fix a bending angle between the head and the handle.

2. The angle retaining assembly of a hand tool as claimed in claim 1, wherein the head is a pair of pliers.

3. The angle retaining assembly of a hand tool as claimed in claim 1, wherein the head is a pair of scissors.

4. The angle retaining assembly of a hand tool as claimed in claim 1, wherein the at least one screw hole is formed at a front side of the connecting portion.

* * * * *